US008123885B2

(12) United States Patent
Sadlier

(10) Patent No.: US 8,123,885 B2
(45) Date of Patent: Feb. 28, 2012

(54) METHOD OF MANUFACTURING FLEXIBLE COVERS

(75) Inventor: Claus E. Sadlier, Woodside, CA (US)

(73) Assignee: Covermate, Inc., Hayward, CA (US)

( * ) Notice: Subject to any disclaimer, the term of this patent is extended or adjusted under 35 U.S.C. 154(b) by 336 days.

(21) Appl. No.: 12/582,891

(22) Filed: Oct. 21, 2009

(65) Prior Publication Data

US 2010/0207297 A1 Aug. 19, 2010

Related U.S. Application Data

(60) Provisional application No. 61/153,182, filed on Feb. 17, 2009.

(51) Int. Cl.
*B32B 37/04* (2006.01)

(52) U.S. Cl. ..... 156/161; 156/196; 156/308.4

(58) Field of Classification Search ..... 156/160, 156/161, 229, 70, 383, 494
See application file for complete search history.

(56) References Cited

U.S. PATENT DOCUMENTS 1,997,738 A 4/1935 Maxedon et al.
(Continued)

FOREIGN PATENT DOCUMENTS

WO WO 00/39005 A1 7/2000
(Continued)

*Primary Examiner* — John L. Goff
*Assistant Examiner* — Barbara J. Musser
(74) *Attorney, Agent, or Firm* — David Pressman

(57) ABSTRACT

A flexible, elastically gathered cover for food containers or the like, and a method of making such covers, uses a forming machine with a lower section having: a) a square shaped forming mandrel having a top, four substantially vertical sides, and a heating element extending longitudinally along each side, b) four elongated sealing bars having a tops with a guide and a front with an elongated strip of rubber attached, and c) a cover ejector with upwardly extending ejector pins. Each sealing bar is positioned opposite a respective side of the forming mandrel separated to create a forming groove around the mandrel. An upper section having a forming head assembly comprises: a) a forming die with sides that define a cavity sized to telescope over the forming mandrel, and b) a band ejector plate with plural downwardly extending ejector pins located along the perimeter. The forming die hangs below the band ejector plate. The mechanism is able to produce, in an automated sequence, flexible covers having a gathering elastic periphery that are suitable for covering open-topped containers.

20 Claims, 15 Drawing Sheets

U.S. PATENT DOCUMENTS

| | | | |
|---|---|---|---|
| 2,064,411 | A | 12/1936 | Brandstein |
| 2,466,643 | A | 4/1949 | Magid |
| 2,478,121 | A | 8/1949 | Morner |
| 2,484,340 | A | 10/1949 | Gardner |
| 2,490,451 | A | 12/1949 | Magid |
| 2,580,075 | A | 12/1951 | Clark et al. |
| 2,768,107 | A | 10/1956 | Magid |
| 3,035,960 | A | 5/1962 | Farkas et al. |
| 3,246,446 | A | 4/1966 | Powers |
| 4,509,570 | A | 4/1985 | Eby et al. |
| 4,560,434 | A | 12/1985 | Sato |
| 4,691,390 | A | 9/1987 | McKeown |
| 4,765,854 | A | 8/1988 | McKeown |
| 4,844,248 | A | 7/1989 | Forberg et al. |
| 4,938,607 | A | 7/1990 | Kelley |
| 5,553,733 | A | 9/1996 | Rosenthal |
| 5,749,989 | A | 5/1998 | Linman et al. |
| 6,351,852 | B1 | 3/2002 | Propp |
| 6,793,090 | B2 | 9/2004 | Ackermann |
| 6,820,283 | B2 | 11/2004 | Graneto |
| 6,994,469 | B2 | 2/2006 | Sleight et al. |
| 7,011,228 | B2 | 3/2006 | Ordiway |
| 7,051,895 | B2 | 5/2006 | Toussant et al. |
| 7,318,534 | B2 | 1/2008 | Turvey et al. |
| 2004/0086205 | A1 | 5/2004 | Raterman |
| 2007/0036472 | A1 | 2/2007 | Perenda |
| 2009/0183807 | A1 | 7/2009 | Sadlier |

FOREIGN PATENT DOCUMENTS

| | | | |
|---|---|---|---|
| WO | WO/2005/115860 | A1 | 12/2005 |

METHOD OF MANUFACTURING FLEXIBLE COVERS

CROSS-REFERENCE TO RELATED CASES

This application claims priority of my copending provisional patent application, Ser. No. 61/153,182, filed Feb. 17, 2009, and is related to my applications, Ser. No. 11/840,019, filed Aug. 16, 2007 on a more versatile cover and method of manufacture, Ser. No. 12/363,528, filed Jan. 30, 2009 on a method of orienting a cover, and Ser. No. 12/369,629 now abandoned, filed Feb. 11, 2009 on a method and dispenser for flexible covers.

BACKGROUND

1. Field

The field hereof is container covers. More particularly, the present disclosure relates to an improved method of making a flexible container cover with an elastic encircle opening.

2. Prior Art

There are number of different types of container or plate covering systems of which I am aware.

One type is a fixed-size container lid which is sized and manufactured to fit a specific container. For example plastic food storage containers such as those sold under the trademark Tupperware generally have matching plastic lids. This approach requires that a specific matching lid be available to cover the container. The lids cannot be used on a different size or shape container.

The second type of product offering and system for covering plates and bowls as well as containers is flexible plastic film and aluminum foil generally provided in a continuous sheet on a roll, such as rolls of plastic wrap sold under the trademark Saran or foil sold under the trademark Reynolds. In order to cover a plate or bowl, the user simply cuts a length of the film or foil and manually molds the cut film or foil over the container. Although this system is flexible enough to cover containers of various sizes and shapes, it is often difficult to cut the film to the correct length and apply it to a container without the film sticking to itself or its edges lifting from the container. Additionally it is difficult to re-cover a container with the same piece of film since plastic films lose their ability to stick to the container after prolonged use, and aluminum foils tear and become wrinkled. Also, foil is not transparent and thus does not allow users to see what is stored in the container. And because it is metallic it cannot be used in some microwave ovens.

The third type of bowl, plate, and container cover is a flexible film cover with an elastic band sewn or stitched around the opening. This type of product has been commercially available and for many years. The same or a similar product is also sold as a shower cap. SC Johnson Co. has sold this type of container cover under their trademark Quick Covers. This type of cover is made from a circular sheet of plastic film, also known as a blank, with a strip of elastic sewn around the perimeter. The elastic, being shorter than the circumference of the blank, gathers the edge of the blank to the center and creates a cover similar in appearance to a shower cap.

There are three drawbacks to this design. The first is that it is unsanitary and unsightly for use with food items due to the fact that the elastic band is stitched to the plastic so that the thread and the ends of the elastic are not contained within, and often hang from the cover. The elastic is also prone to separating at the stitches after a number of uses. The second drawback is that these covers cannot be mass produced on high speed machinery because the elastic must be sewn around the perimeter of the sheet. The third drawback is that these covers do not fit both elliptical and rectangular containers with similar size openings, nor do they fit elongated rectangular shaped container, and therefore have relatively low versatility.

U.S. Pat. Nos. 2,490,451 to Magid (1949) and 3,035,960 to Farkas et al. (1962) disclose covers with an elastic band heat sealed into a hem along the periphery of a circular sheet of plastic film. Although these covers eliminate the unsanitary and undesirable aesthetics of the above stitched type of cover, they do not fit both elliptical and square containers with similar size openings, nor do they fit elongated rectangular containers. Furthermore, the method of manufacturing the covers of both patents requires multiple forming head to form the sheet and the band. Also it is difficult to remove the finished covers from the sealing apparatus, and thus they cannot be made on high speed machinery. Finally, these covers completely enclose the elastic band in a sealed edge which is not functional in a microwave oven because the air trapped within the hermetically sealed hem will expand when heated in a microwave, which can cause the hem to burst, thereby destroying the cover.

In my above copending application Ser. No. 11/840,019 I disclose an improved more versatile cover and method of manufacture. This cover is made from a rectangular sheet of plastic film material, or blank, and an elastic band. The sheet has a predetermined amount of material cut from each corner. The sheet is placed onto a table between four posts that extend from the table. The sheet is positioned so that a post lines up with each corner of the sheet. A rubber band is stretched across the four posts into a similar shaped rectangle and rests just above the sheet. The stretched rubber band now has four sides which correspond to the four sides of the sheet. The side edges of the sheet are folded inward and over the stretched band and heat sealed directly to the sheet, sealing the band within four pockets that are formed along the sides of the sheet. Each corner of the stretched band is released from its post, allowing the band to relax and pull the four corners of the sheet toward the center to form the cover.

While this cover and its method of manufacture is a substantial improvement over prior covers, there are three areas that could be improved further. The first area in need of improvement is that the forming method requires a cut in each corner to allow room for the elastic band holding post, which leaves an opening in the hem at each corner of the cover exposing a portion of the band. While this eliminates the problem discussed above of a bursting hem when used in a microwave, and does not cause a functional problem because the location of the cut or hole is below the rim of the container being covered, the exposed band has the potential to look like a manufacturing defect to some customers. The second area in need of improvement is the process step of stretching and placing the rubber band around the holding posts. This step requires a high degree of precision to position the stretched rubber band directly above the sheet so that the sides of the sheet can be folded over the band in order to be heat sealed. This step slows the manufacturing process and limits the process capability for high speed automation. There is also a limitation in my above referenced applications in that the cover formed by the folding over an elastic band method requires that the starting blank have substantially straight sides. While a rectangular blank provides maximum flexibility in being able to cover round, rectangular, square, oval, or any other shaped container, there could be a situation where a customer would want a cover made from a round blank.

ADVANTAGES

Accordingly, some advantages of one or more aspects are to provide an improved method of manufacturing a flexible cover and article thereof that: a) can be round or rectangular in shape and thereby cover both round and rectangular shaped containers, b) eliminates a cut or hole in the hem at each corner which exposes a portion of the elastic band, c) allows air to escape from the hem to prevent the hem from bursting when used in a microwave oven, d) utilizes a forming head which simultaneously forms the sheet and applies the elastic band, e) can be automatically striped from the sealing apparatus, f) can be made on high speed automated machinery, and g) can be integrated into an automated assembly line process. Other advantages of various aspects will be apparent from a consideration of the following description and the accompanying drawings.

SUMMARY

In accordance with one aspect, an apparatus and method for making a flexible container cover comprises a forming machine with a lower section having: a) a square shaped forming mandrel having a top, four substantially vertical sides, and a heating element extending longitudinally along each side, b) four elongated sealing bar mechanisms each having a top side with a sheet guide and a front side with an elongated strip of rubber attached thereto, and c) a cover ejector plate with plural upwardly extending ejector pins. Each sealing bar mechanism is positioned opposite a respective side of the forming mandrel separated by predetermined distance to create a forming groove, recess or moat around the forming mandrel. Each adjacent sealing bar is separated by a small gap. The cover ejector mechanism is positioned below the forming mandrel so that the ejector pins align with clearance holes cut through the forming mandrel. An upper section having a forming head assembly comprises a) a forming die with sides that define a cavity sized to telescope over the forming mandrel, and b) a band ejector plate with plural downwardly extending ejector pins located along the perimeter. The forming die hangs below the band ejector plate by the use of shafts which extend from the forming die through clearance hole in the ejector plate and are held in place by shaft collars at the top of each shaft. The ejector pins extend downwardly from the ejector plate and are centered within gaps cut into the sides of the forming die.

With the forming head assembly in an up position a square sheet of plastic film is positioned on top of the forming mandrel. Each side of the sheet extends past the sides of the mandrel and rest on top of each sealing bar within the sheet guides. An elastic band is stretched and placed around the sides of the forming die. The forming head assembly is actuated downward so that the forming die telescopes over the forming mandrel forcing a marginal portion of the sheet downward into the moat in a V-shaped cross sectional configuration. Next the forming die hits a mechanical stop while the band ejector mechanism continues to move downward causing the ejector pins to push the elastic band off of the forming die and snap securely around the sides of the forming mandrel, thereby holding the sheet in place. Next the forming head assembly is returned to the up position and the sealing bars are actuated inward to push the sides of the sheet against the mandrel to form a hem enclosing the elastic band. As the sealing bars are actuated the heating element is switched on which melts and seals the plastic to form a seam which encloses the elastic band within a continuous hem along the periphery of the sheet. An unsealed pleat is formed within the hem at the location of the gap between adjacent sealing bars. Next the side sealing bars are returned to the outward position and the cover ejector mechanism is raised such that the ejector pins move through the clearance holes in the forming mandrel and push the underside of the plastic sheet upward which automatically strips the formed cover from the forming mandrel. Finally, the ejector plate is retracted back down through the mandrel which strips the cover from the ejector pins. Once released from the ejector pins, the elastic band relaxes to its natural free length, which is less than the length of the perimeter or circumference of the blank. Thus the elastic band draws or gathers the sides and corners inward towards the center, forming the sheet into a hollow cover with an expandable opening. The elastic band is sealed within a continuous hem around the periphery of the sheet having an unsealed pleat which prevents air from being trapped within the hem area when the cover is heated in a microwave.

In another aspect a blast of compressed air or mechanical means is used to fill the gaps between adjacent sealing bars to eliminate an unsealed pleat and provide a continuous and hermetically sealed hem containing an elastic band.

In another aspect the forming mandrel, forming die and associated parts are configured in an elongated rectangular shape in order to form a cover from an elongated rectangular blank designed to cover round, square or elongated rectangular containers. In yet another aspect the forming mandrel, forming die and related parts are configured in an elliptical shape to form a cover from a round blank.

In another aspect a flexible container cover comprises a rectangular sheet of film having an elastic band sealed within a hem around the periphery of the sheet in which pleats are sealed at each corner, but there is an absence of sealed pleats along each side.

In another aspect a flexible container cover comprises a sheet of film having an elastic band sealed within a hem around the periphery of the sheet with the hem having an un-pleated, unsealed area to prevent air from being trapped within the hem in order to prevent the hem from bursting when used in a microwave.

In yet another aspect a rectangular sheet of film having a straight chamfer cut at each corner is formed into a flexible container cover having curved corners.

In another aspect a fully automated process is provided comprising die cutting, elastic band feeding, cover forming and ejecting, and finish product accumulation. In timed sequence a die cutter station is provided which cuts the sheet or blank from a roll of film material. Next the blank is automatically placed onto the forming mandrel of the forming machine. Next an elastic band feeding apparatus stretches and applies an elastic band around the forming die of the forming machine. Next the forming machine forms and ejects a finished cover. Lastly, an accumulator picks up the ejected cover and stacks the cover in an accumulation bin for final packaging.

These and other aspects and features of the disclosure will become more apparent from the following detailed description when taken in conjunction with the accompanying drawings.

DRAWING FIGURES

REFERENCE NUMERALS

| | | | |
|---|---|---|---|
| 100 | Frame | 110 | cover ejector plate |
| 110A | assembly line ejector plate | 112 | cover ejector pin |
| 114 | cover ejector air cylinder | 120 | square forming mandrel |
| 120' | circular forming mandrel | 120A | assembly line forming mandrel |
| 120S | mandrel side | 120T | mandrel top |
| 122 | cover ejector clearance hole | 124 | forming moat |
| 130 | sealing bar | 130' | curved sealing bar |
| 130A | assembly line sealing bar | 132 | rubber strip |
| 134 | sealing bar air cylinder | 136 | sealing bar clearance |
| 136' | sealing gap | 138 | blank guide |
| 140 | band ejector plate | 140B | band ejector bearing |
| 142 | band ejector air cylinder | 144 | band ejector pin |
| 150 | forming die | 150S | forming die side |
| 152 | clearance slot | 153 | die cavity |
| 154 | shaft | 156 | shaft collar |
| 158 | compression spring | 160 | elastic band |
| 170 | square film sheet | 170' | circular film sheet |
| 170" | rectangular film sheet | 170CC | chamfered sheet corner |
| 170HC | curved hemmed corner | 170F | folded edge |
| 170S | sheet side | 170U | unsupported portion |
| 172 | sealed pleat | 173 | unsealed pleat |
| 174 | seam | 175 | unsealed section |
| 176 | hollow body | 177 | Opening |
| 178 | hem | 180 | heating element |
| 182 | heating element gap | 190 | Cover |
| 190" | cover | 300 | forming head assembly |

-continued

| | | | |
|---|---|---|---|
| 300A | assembly line forming head | 310 | compressed air nozzle |
| 400 | rectangular container | 500 | turn table |
| 510 | station one | 512 | station two |
| 514 | station three | 516 | station four |
| 520 | die cutting apparatus | 521 | roll of film |
| 522 | band feeding apparatus | 524 | accumulator apparatus |
| 526 | accumulator bin | 600 | logo |

DETAILED DESCRIPTION

Figure 1A:
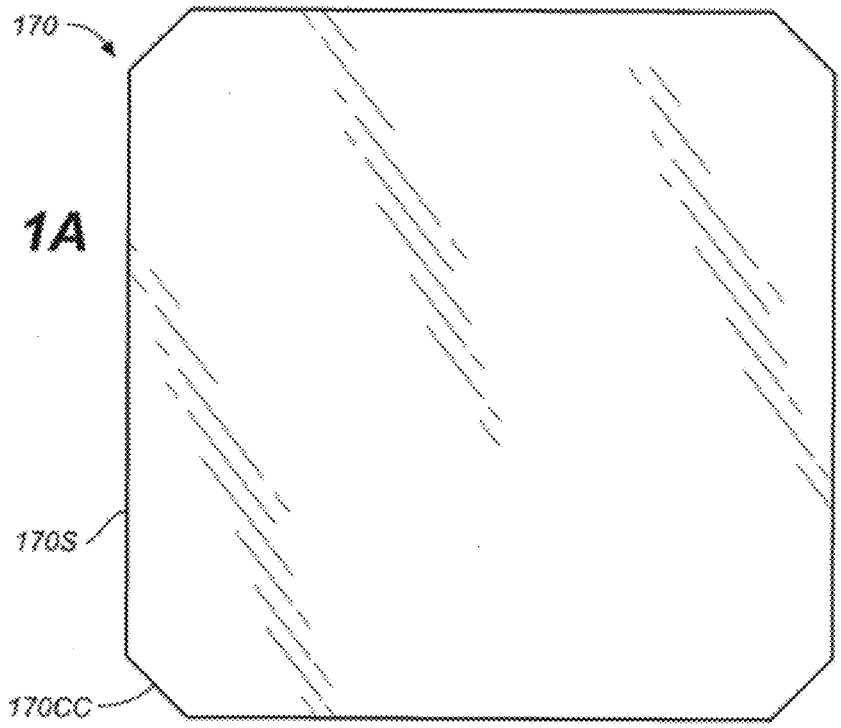
FIG. 1A is a plan view of a sheet blank used to form a flexible container cover.
Figure 1B:
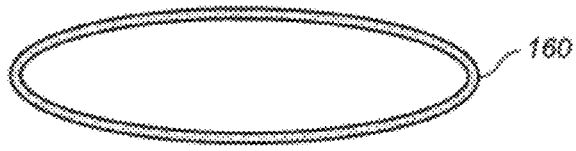
FIG. 1B is a plan view of an elastic band used to form the cover.
Figure 1C:
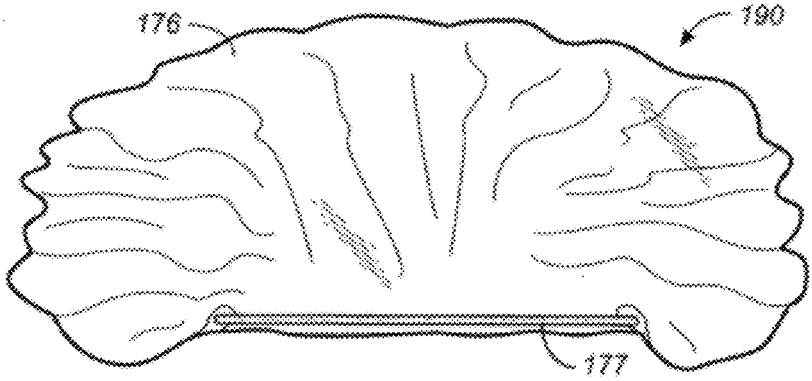
FIG. 1C is a side view of the cover.
Figure 2:
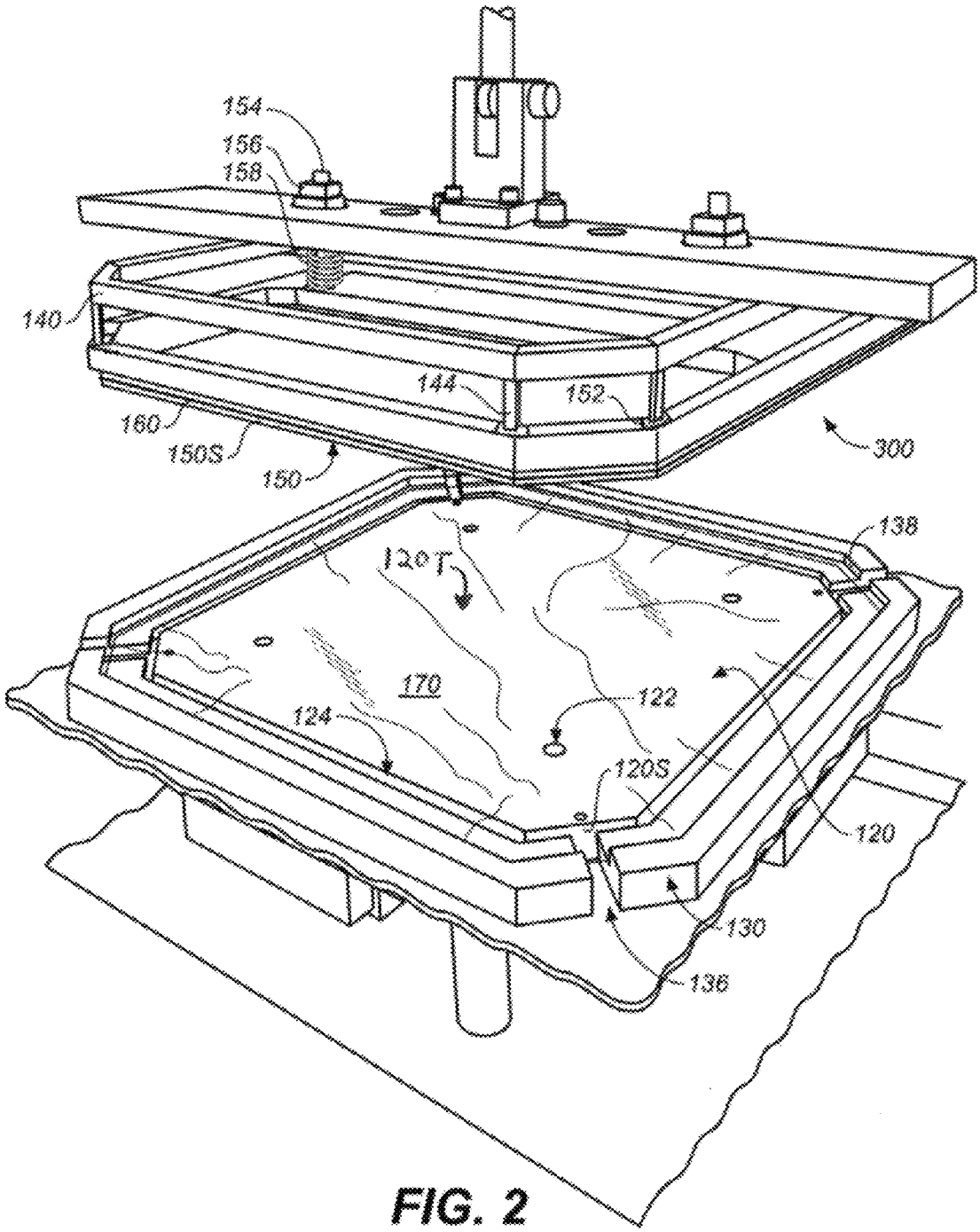
FIG. 2 is an exploded perspective view of an apparatus for forming covers.
Figure 2A:
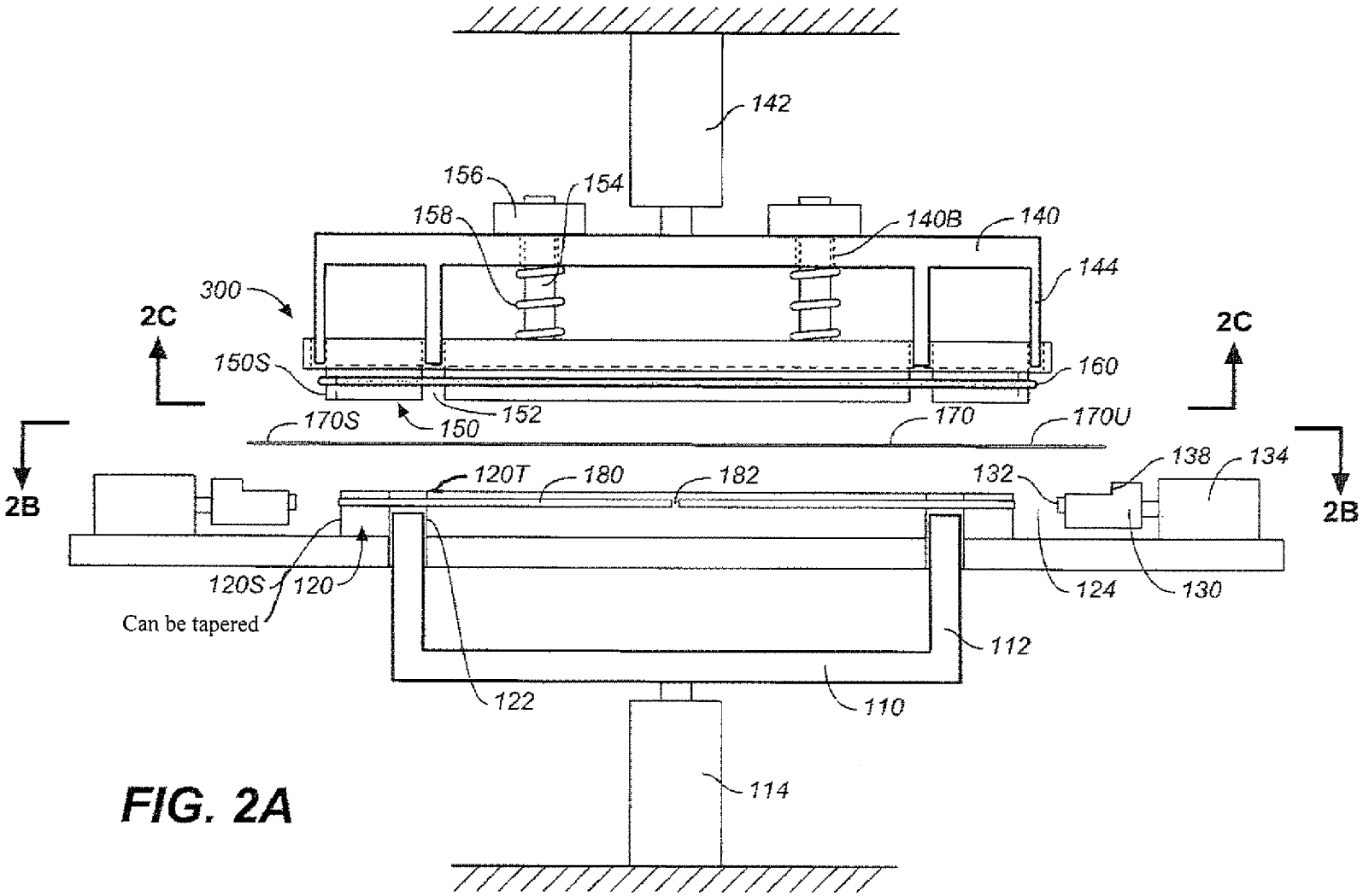
FIG. 2A is a side view of an apparatus for forming covers.
Figure 2B:
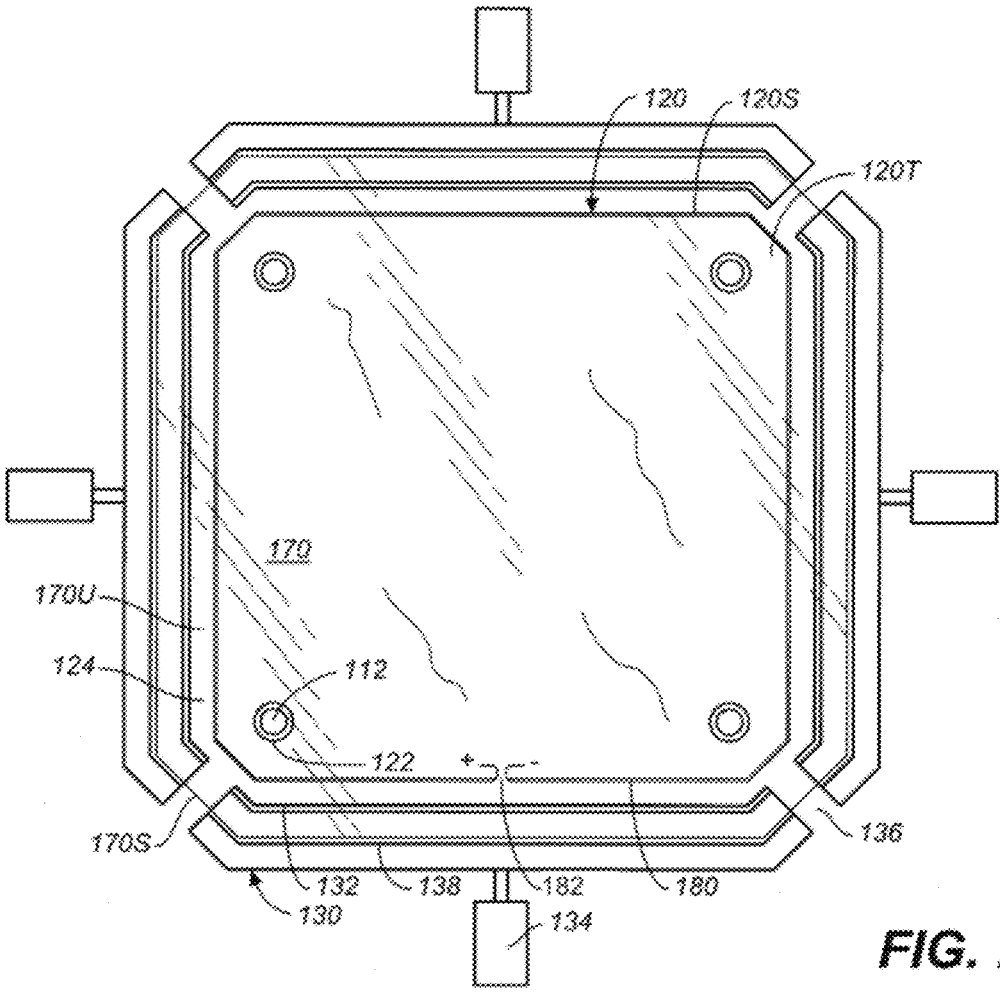
FIG. 2B is a top view of the apparatus taken along line 2B-2B of FIG. 2A.
Figure 2C:
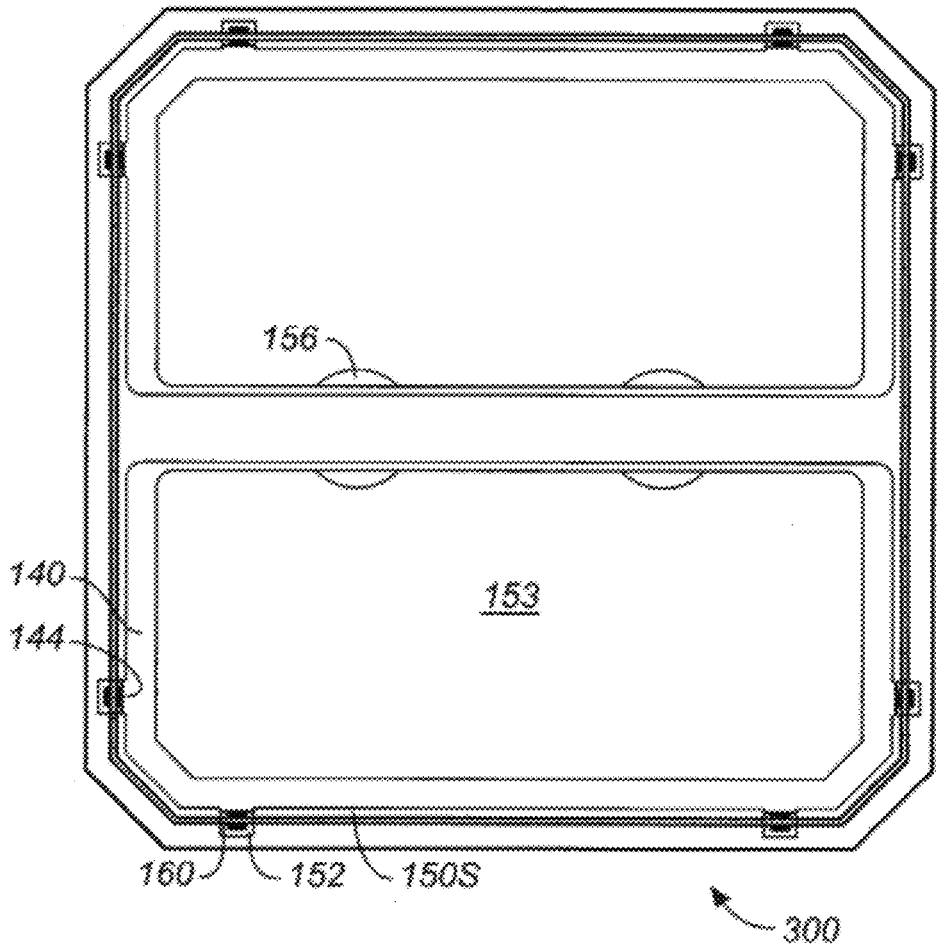
FIG. 2C is a bottom view of the apparatus taken along line 2C-2C of FIG. 2A.

First Embodiment—FIGS. 1-2C

FIGS. 2 and 2A are prospective and side views respectively of the apparatus for forming flexible container covers 190 (FIG. 1C). The forming apparatus comprises an upper section and a lower section secured to a common frame. The lower section, which is also shown in the top view in FIG. 2B, comprises a square forming mandrel 120 having a top side 120T and side walls 120S. In this first embodiment the side walls are vertical or at a 90° angle from the top side for reasons to be explained. The overall length, width, and shape of mandrel top 120T is predetermined by the size and shape of the container cover to be produced. An impulse heat sealing unit is constructed by attaching a heating element 180 longitudinally along sidewall 120S around the perimeter of the mandrel.

The heating element is made from a strip of nichrome wire which is commonly used as a heating element in toasters and hair dryers. Other suitable heating element material well known in the art can also be used. The nichrome wire is insulated from mandrel 120 by use of a strip of heat-resistant insulating tape located between the wire and the mandrel (not shown). The top of the wire is also covered by a strip of heat-resistant insulating tape (not shown). A single strip of wire is wrapped around the entire mandrel ending at its starting point with a small gap 182 between the two ends. The free ends of the wire are connected to a low voltage power source (not shown) which can be turned on and off. When a predetermined amount of electrical current is passed through the wire, electrical resistance causes the wire to get very hot, very quickly. There are a number of different sealing technology well known in the art which could be used as an alternative for impulse heat sealing, such as ultrasonic vibration energy (ultrasonic sealing), high-frequency die electric sealing (induction heating), or a the use of a heated sealing clamp or heated bar.

Mandrel 120 is supported on frame 100 in a horizontal configuration as shown in FIG. 2A. Adjacent each side of the mandrel is an elongated sealing bar 130 with a long strip of rubber 132 attached to the front edge which faces mandrel 120. At the top of sealing bar 130 is a blank guide or stop 138. Sealing bar 130 is attached to an air cylinder 134 (shown in FIGS. 2A and 2B in a retracted position) which is attached to frame 100. A moat or groove 124 is formed between mandrel sides 120S and sealing bar rubber strips 132. As shown in FIGS. 2 and 2B, moat 124 and sealing bars 130 surround the sides of mandrel 120 except for clearance gaps 136 located at each corner between each adjacent sealing bars for reasons to be explained later. A cover ejector plate 110 is positioned below mandrel 120 and is secured to air cylinder 114 (shown in FIG. 2A in a retracted position) which is secured to frame 100. Ejector plate 110 has four ejector pins 112 which extend vertically and are aligned within four clearance holes 122 which run through mandrel 120 as shown in FIGS. 2A and 2B.

The upper section of the apparatus (FIGS. 2, 2A and 2C) comprises forming head assembly 300 which is made up of square forming die 150 which has four sides 150S which define a die cavity 153 of a size and shape designed to telescope over forming mandrel 120 with a predetermined clearance between the sides of the mandrel and the sides of the die. In this first embodiment the clearance is in the range of 1.27 mm (0.050 inch) to 6.35 mm (0.250 inch) but other clearance distances can be used. Forming die 150 is suspended from a band ejector plate 140 which has eight downwardly extending ejector pins 144 along its periphery. The ejector pins are aligned with eight clearance slots 152 cut into the sides of forming die 150. Forming die is supported from ejector plate 140 by two linear motion shafts 154 which extend from the forming die through two bearings 140B in the ejector plate and are held in place by a shaft collar 156 at the top of each shaft. The shafts and bearings allow forming die 150 to move up and down relative to band ejector plate 140. A compression spring 158 is installed on each shaft between forming die 150 and band ejector plate 140 to provide stability between the two parts. Band ejector plate 140 is attached to air cylinder 142 (shown in FIG. 2A in a retracted position) which is attached to frame 100. Forming head assembly 300 is suspended above and aligned with forming mandrel 120.

Operation

First Embodiment—FIGS. 1-7

In accordance with this first embodiment, a flexible container cover 190 (FIG. 1C) is made by placing film sheet or blank 170 (FIG. 1A) on forming mandrel top 120T (FIGS. 2, 2A and 2B). Blank 170 can be any flexible film material such as polyethylene, polypropylene, polyester, nylon that is suitable for use in covering bowls, plates, and other objects, or a combination of these materials. Alternatively a biodegradable film can be used, such as polylactic acid (PLA), or polyvinyl alcohol (PVA), which contains starch in order to biodegrade. The size of blank 170 is predetermined to fit a specific size range of container openings. The thickness of blank 170 can be any thickness of film available. Part or all of blank 170 can have optical properties that are clear, transparent, translucent, and opaque. For this first embodiment a square sheet of low-density polyethylene (LDPE) with a chamfer cut at each corner 170CC and a thickness of 0.0254 mm (0.001 inch) is used. The sides 170S of the blank extend past the sides 120S of the mandrel and rest on top of sealing bars 130 within blank guides 138 as shown in FIGS. 2A and 2B. There is an unsupported portion 170U of the blank between the sides of the forming mandrel and the tops of the sealing bars.

Next an elastic band 160 (FIG. 1B) is stretched and placed around forming die sides 150S as shown in FIGS. 2, 2A and 2C. The elastic band is preferably made from any thin elastic material such as latex (natural rubber), or latex-free material, such as polyisoprene, polyurethane, or combination of these and other materials in any color available. The elastic element has an unstretched, relaxed or free length that is less than the length of the perimeter or periphery of the plastic sheet for reasons to be discussed.

Figure 3A:
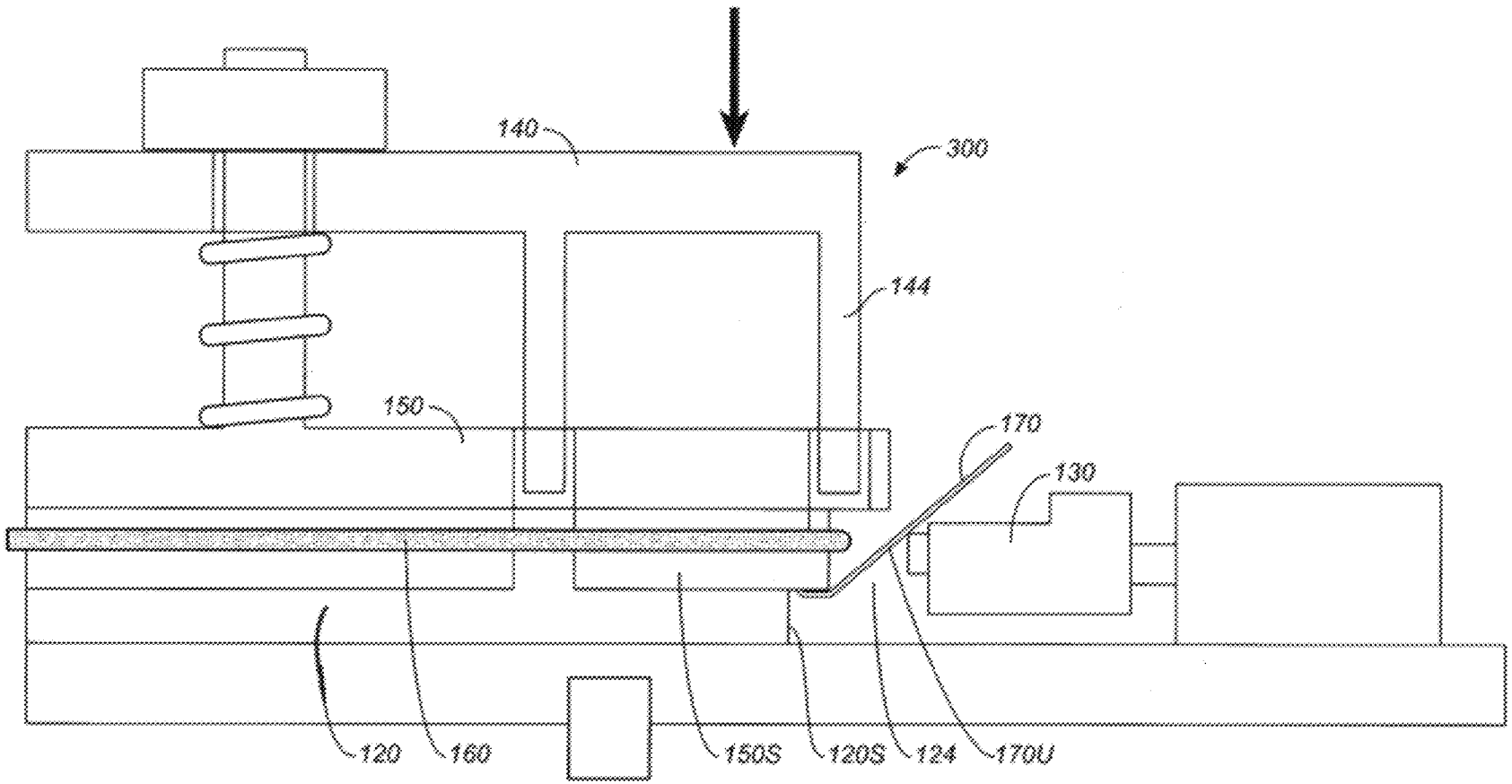
FIG. 3A is a partial side view of a forming die in the down position forcing a sheet for forming the cover into a forming groove.

As shown in FIG. 3A, forming head assembly 300 is lowered (by activating air cylinder 142 FIG. 2A) so that forming die 150 telescopes around forming mandrel sides 120S and stops at a predetermined level. This causes forming die sides 150S to push the unsupported portion 170U of the blank into groove or moat 124 that surrounds the mandrel. The plastic sheet extends from the top of the mandrel, downward into the moat area, around the side of the forming mandrel, and back up to the top of the sealing bar in a V-shaped cross-sectional pattern.

Figure 3B:
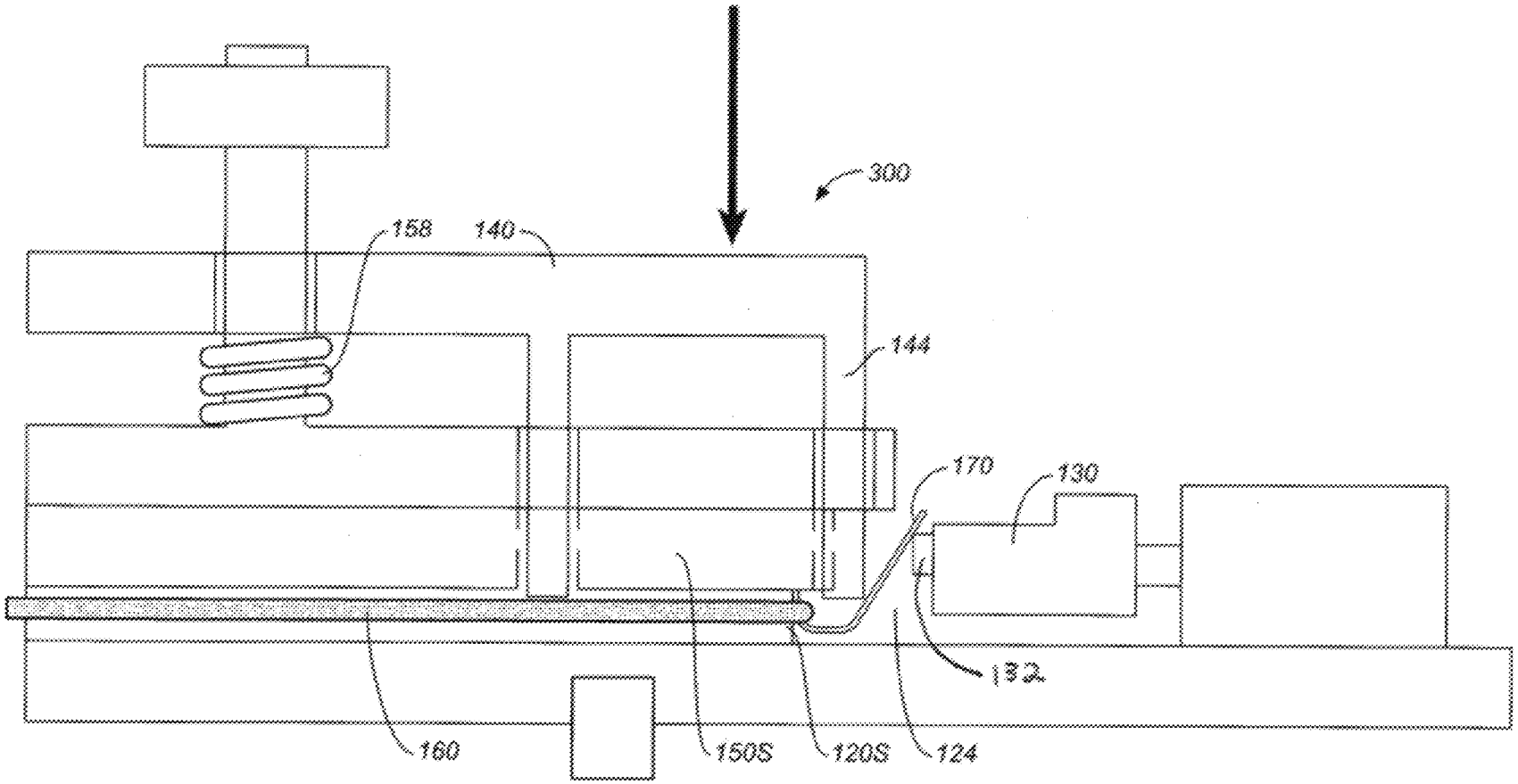
FIG. 3B is a partial side view of the band ejector in the down position immediately after pushing the elastic band off of the forming die with the band holding the side of the sheet against the side of the forming mandrel.

Next, as shown in FIG. 3B, with the forming die 150 stationary, band eject plate 140 continues to move downward, compressing springs 158 and causing the band ejector pins 144 to roll or push elastic band 160 off of the forming die. The elastic band then snaps against the mandrel sidewalls 120S, holding blank 170 firmly in place against the sides of the mandrel. The plastic sheet flows from the top of the mandrel, down the sidewall under and around the elastic band, and then back up to the top of the sealing bar in a generally U-shaped cross-sectional pattern.

Figure 4A:
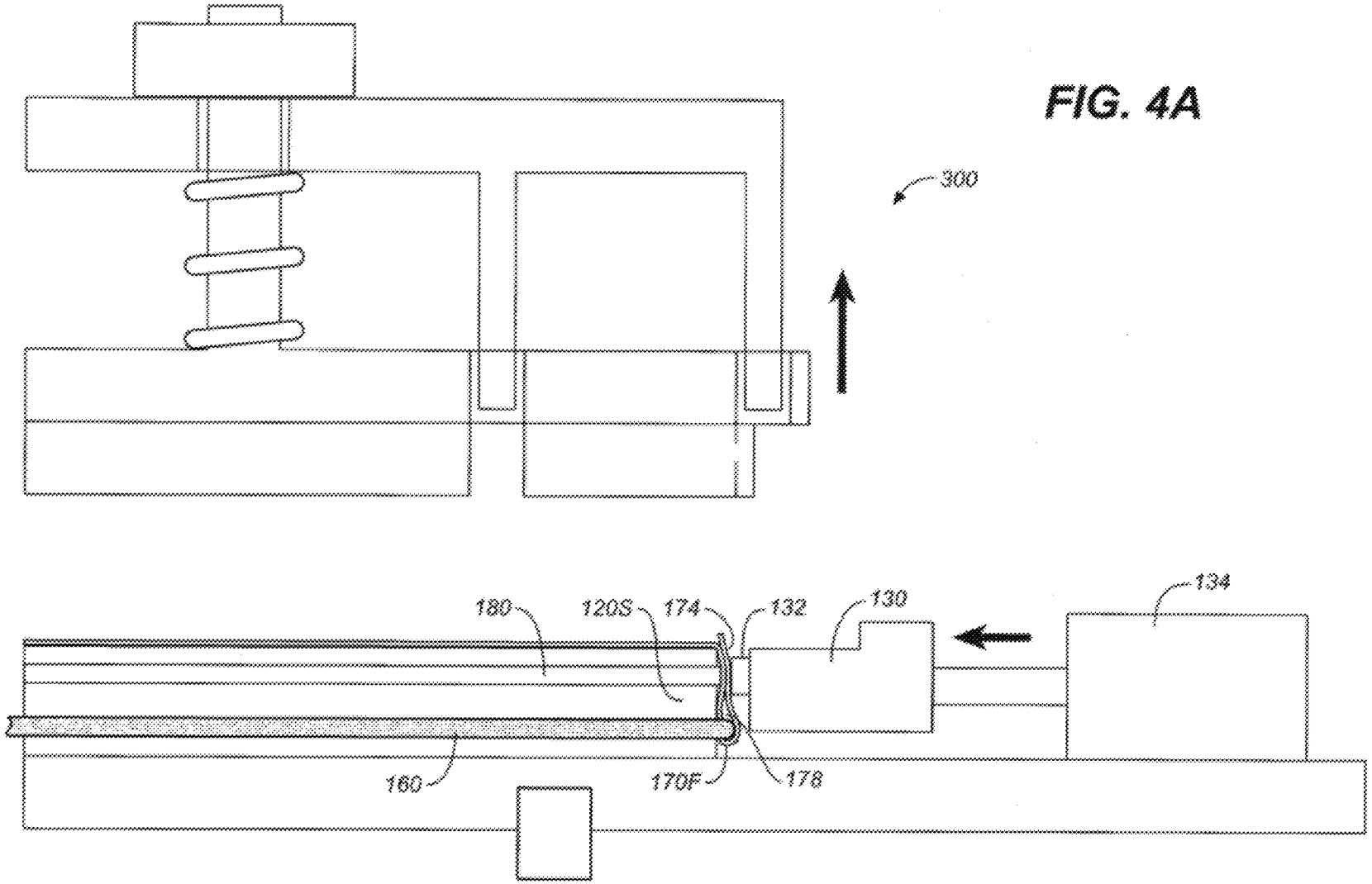
FIG. 4A is a partial side view of a sealing bar sealing the edge of the sheet to form a hem which encapsulates the elastic band.
Figure 4B:
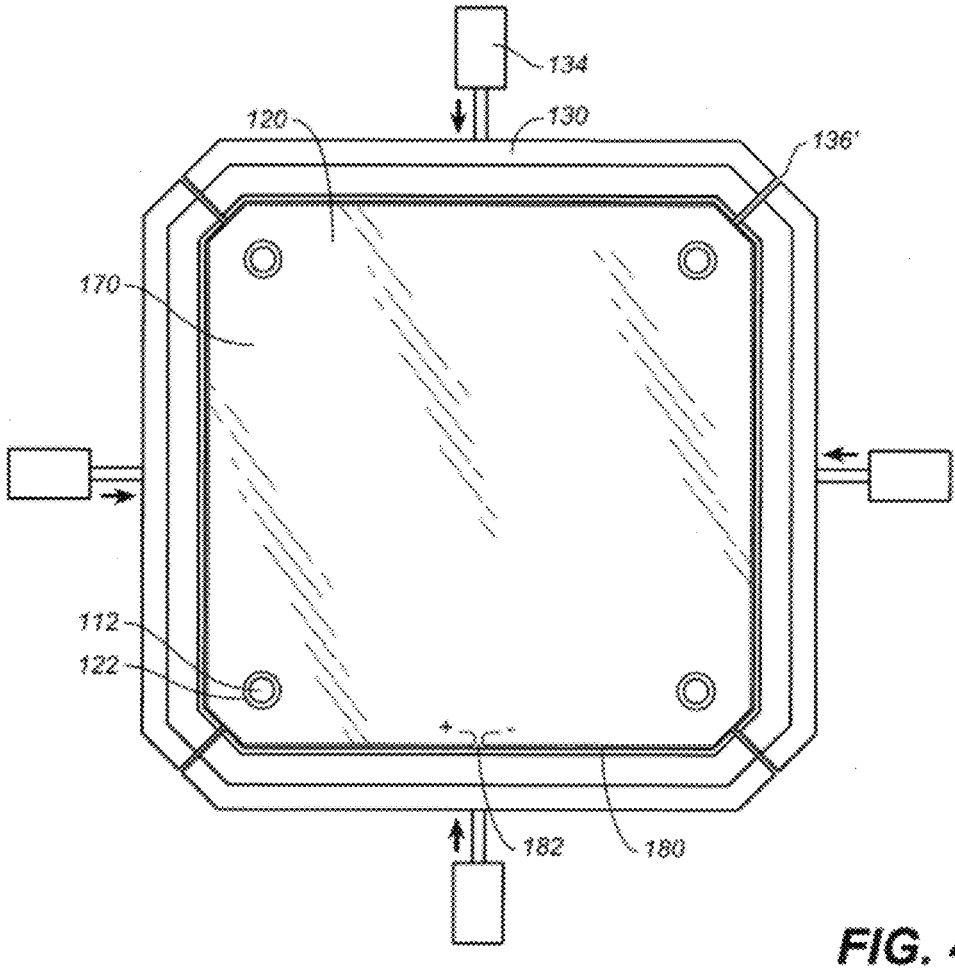
FIG. 4B is a top view of sealing bars sealing the edge of the sheet along each side.

As shown in FIGS. 4A and 4B, forming head assembly 300 is returned to its original retracted position by deactivating air cylinder 142 FIG. 2A. Next sealing bars 130 are moved forward by activating air cylinders 134, pushing the sides of blank 170 inward to form a folded edge 170F adjacent elastic band 160. This creates a hem 178 encapsulating the elastic band. Sealing bar clearance 136 (FIGS. 2 and 2B) is reduced in size as the bars move forward toward the mandrel, forming sealing gap 136' (FIG. 4B). Simultaneous with the extension of sealing bar 130, electricity is applied to heating element 180, causing it to become hot to melt and fuse an overlapping portion of the blank to form a seam 174 around the periphery.

Figure 5:
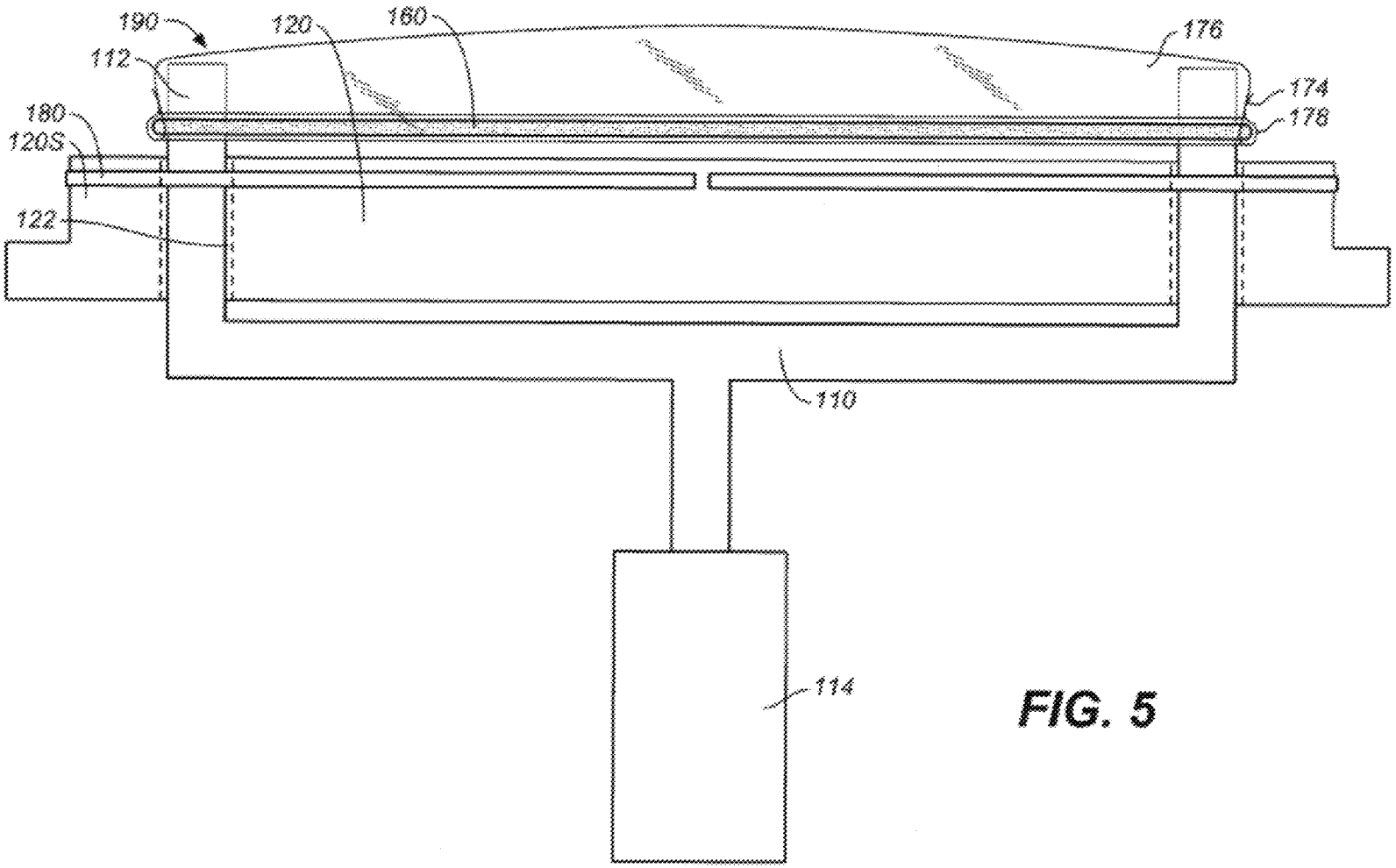
FIG. 5 is a partial side view of a cover eject mechanism in an up position immediately after stripping the finished cover from the sides of the forming mandrel.

Turning now to FIG. 5, the sealing bars are returned to their original retracted positions. Next cover ejector plate 110 is raised by activating air cylinder 114 so that cover ejector pins 112 extend through clearance holes 122 which are bored through mandrel 120. The tops of the eject pins contact the underside of sheet 170, thereby lifting it upward and automatically pushing or stripping it from the mandrel. As discussed above, mandrel side walls 120S are vertical or at a 90° angle from the top of mandrel 120T. This allows the cover to be pushed off easily. The mandrel side wall can also have a slight taper with an angle in the range between 70° to 110° from the mandrel top, provided that the taper is gentle enough to allow the cover to be pushed off by the eject pins.

Figure 6:
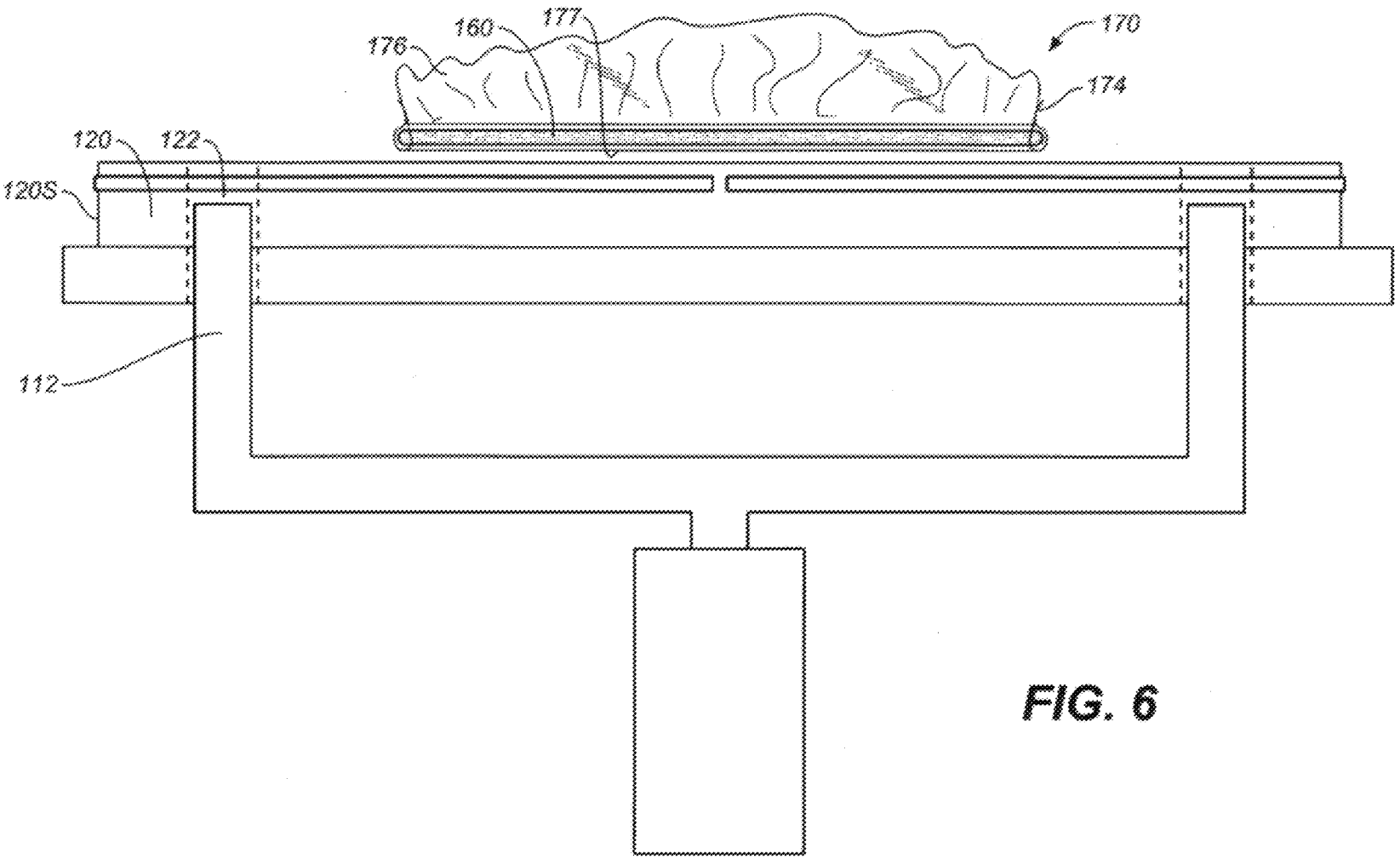
FIG. 6 is a partial side view of a finished and loose cover immediately after the cover eject arms are lowered back through the forming mandrel.

FIG. 6 shows the final step of the process in which ejector pins 112 are retracted. This causes cover 190 to be stripped from the eject pins as they return back through clearance holes 122. FIG. 6 shows cover 190 after the elastic band has been allowed to relax to its natural free length, which is less than the length of the perimeter or circumference of blank 170. Thus the elastic band has drawn or gathered the sides and corners inward towards the center, forming the sheet into cover 190 comprising a hollow body 176 with an expandable opening 177.

Figure 7:
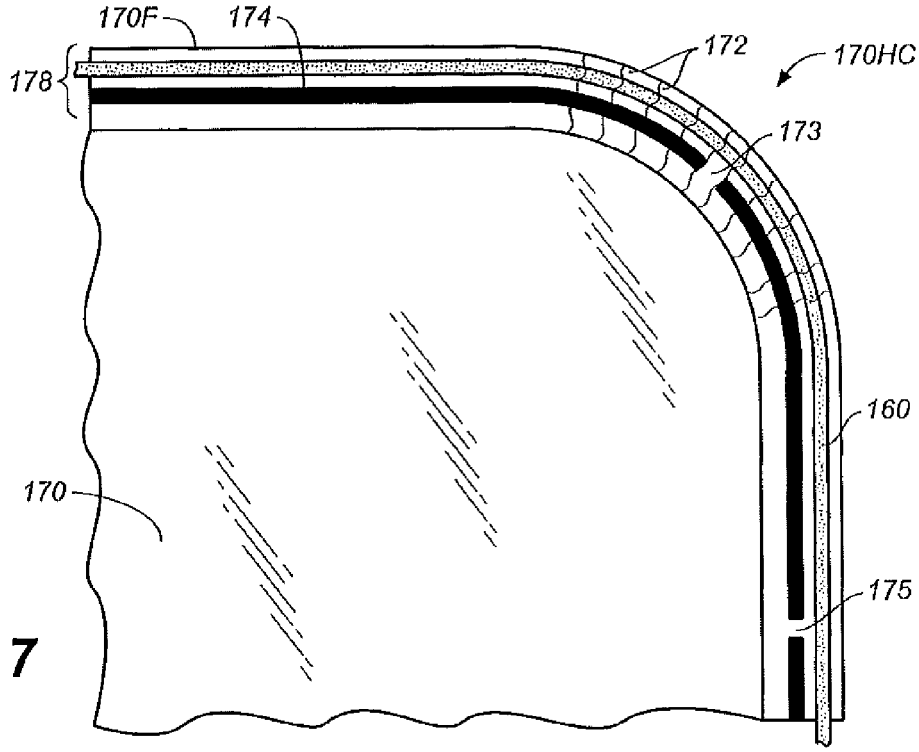
FIG. 7 is a partial plan view of formed cover in a stretched configuration showing the hem, pleating, and sealing pattern.

FIG. 7 illustrates a portion of cover 190 in a fully stretched and open configuration and shows elastic band 160 covered by a continuous hem 178 defined by folded edge 170F and seam 174 formed by the apparatus and method. Multiple pleats 172 are arranged along each curved hemmed corner 170HC and are traversed or crossed and sealed by seam 174. There is an absence of pleats when the cover is stretched along each straight side. The pleats result because the perimeter of the sheet at each corner is larger than the perimeter of moat at each corner, so the sheet folds, creases, or pleats along this area and the pleats are traversed or crossed and sealed by the seam, with one exception. An unsealed pleat 173 is located at a point which corresponds to sealing gap 136' (FIG. 4B) between adjacent sealing bars. This unsealed pleat is formed when sealing bars 130 push the sides of the sheet inward (FIG. 4B), which causes a small amount of the sheet to fold or crease into gap 136' between adjacent sealing bars, which prevent it from being sealed. This unsealed pleat in finished cover 190 prevents air from being trapped within the hemmed edge, which prevents the hem from exploding when the cover is used in a microwave oven.

Other means of leaving an unsealed area in the hem to allow air to escape can be used. For example gap 182 (FIG. 2A) formed between the adjacent ends of the wrapped heating element wire can be adjusted to a predetermined size in order to leave a small unsealed section or gap 175 in the seam. Alternatively, a small section of rubber strip 132 can be removed (not shown) which would eliminate sealing pressure at that point and leave an unsealed gap in the seam at a location corresponding to the gap in the rubber strip. The unsealed gap can be formed on a curved or straight section of the cover and need not have a pleat associated with the unsealed gap. Alternatively, one or more holes can be punched into the blank at a location which forms the hem to prevent air from being trapped in the hem. FIG. 7 shows hem 178 forming a curved corner 170HC. Corner 170HC is formed from chamfered corner 170CC on blank 170 by the pleating effect discussed above. A rectangular cover formed with round corners provides a tighter fit on certain rectangular and oval casserole type dishes, and is an unexpected benefit of the pleating phenomenon.

Figure 8:
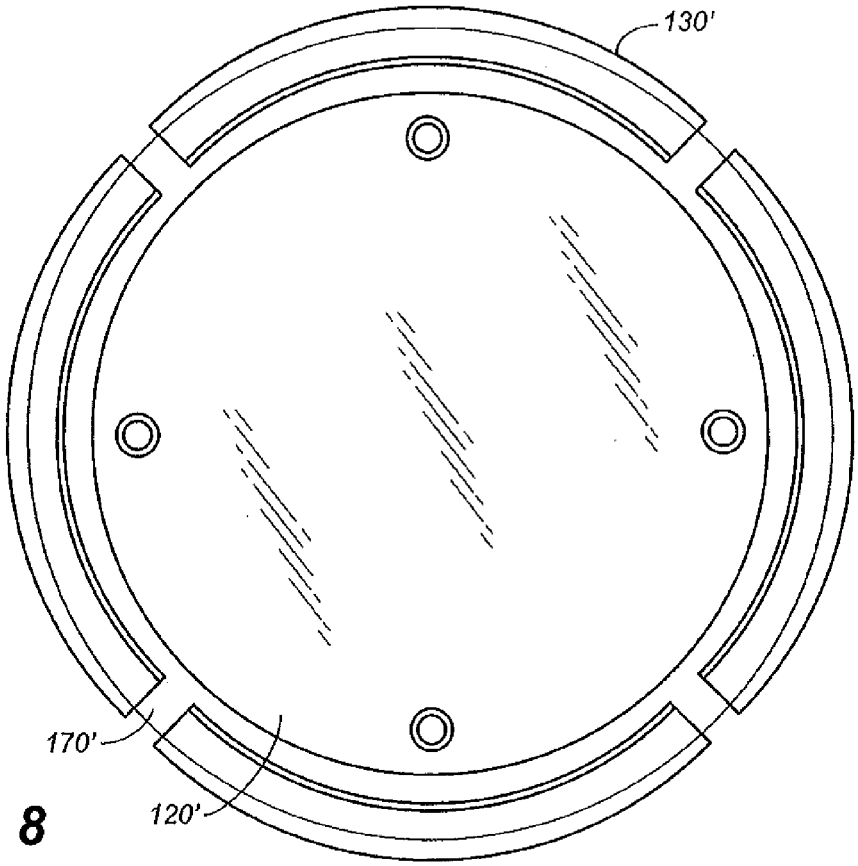
FIG. 8 is a plan view of apparatus parts used to make a cover from a circular blank.
Figure 9A:
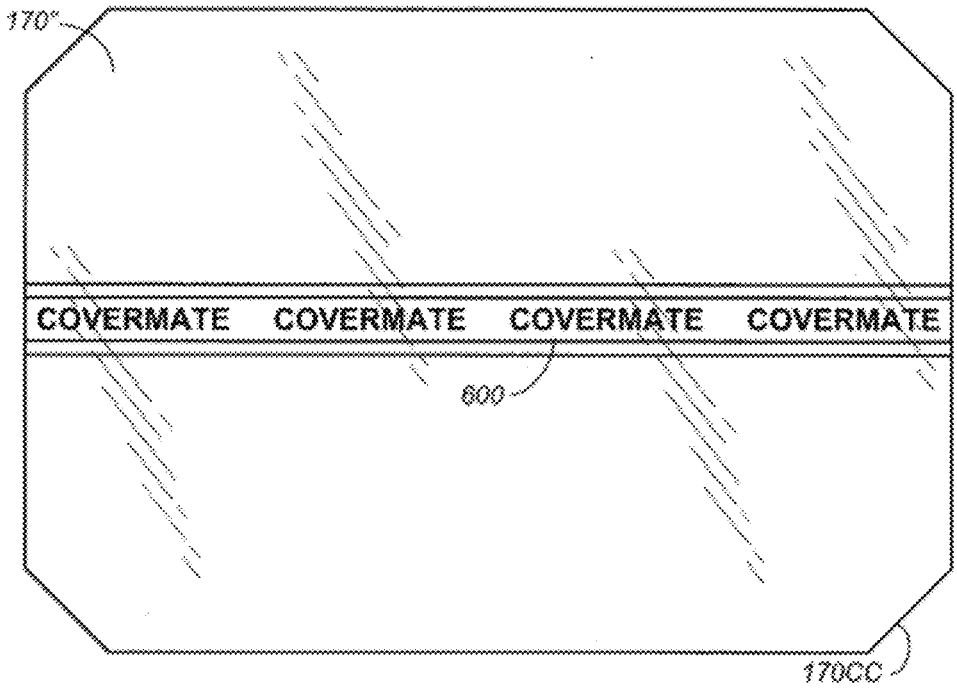
FIG. 9A is a plan view of an alternative embodiment blank used to make a flexible container cover.
Figure 9B:
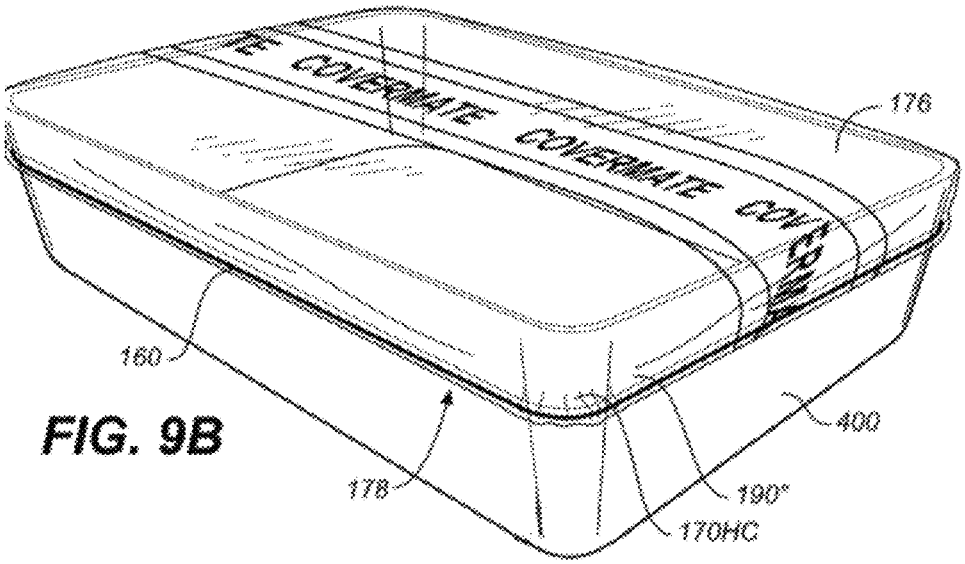
FIG. 9B is a perspective view of the alternative embodiment cover made from the blank shown in FIG. 9A covering a rectangular shaped dish.
Figure 10:
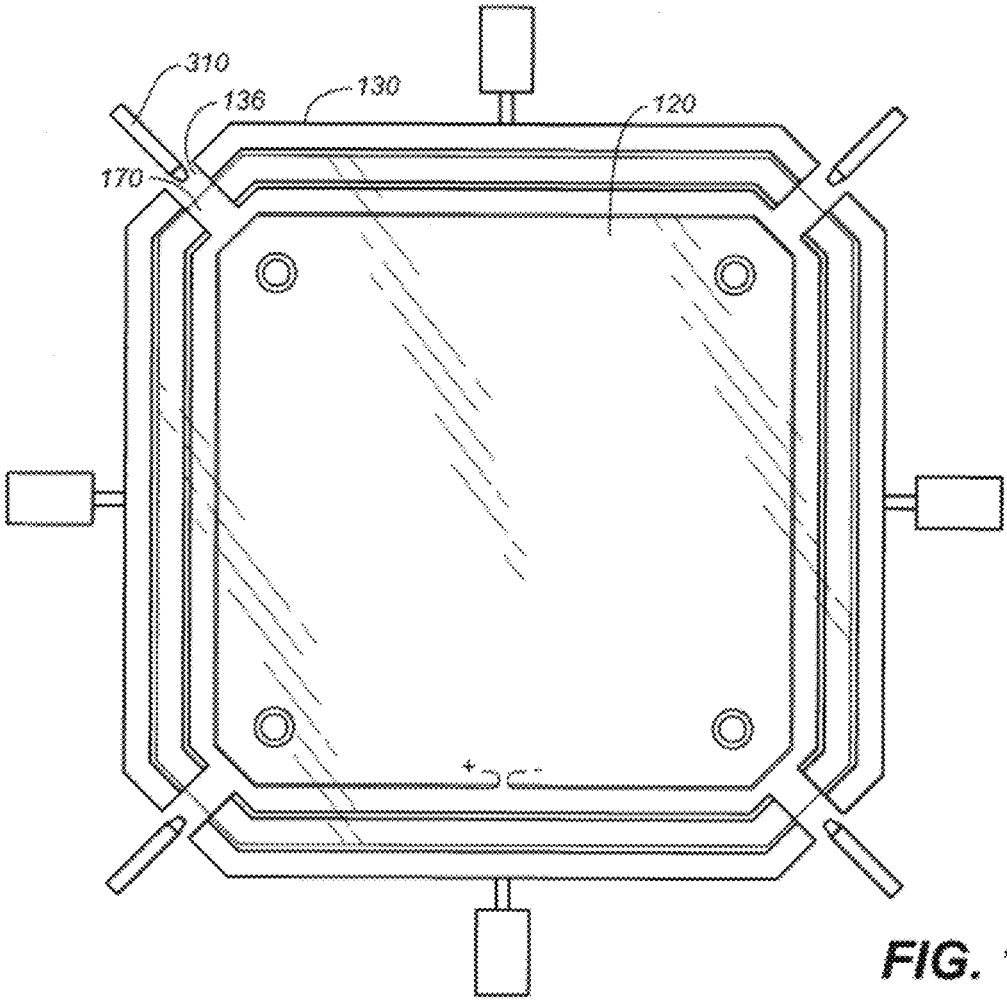
FIG. 10 is a plan view of apparatus parts used to make a hermetically sealed seam.

Alternative Embodiments—FIGS. 8 to 10

FIG. 8 illustrates an alternate embodiment for making a circular container cover. In order to form a circular cover from the apparatus, a circular blank 170' would be used in combination with a circular forming mandrel 120' and curved sealing bars 130'. Similar modifications to the forming die and band eject plate (not shown) would be made.

FIG. 9A illustrates an alternative elongated rectangular blank 170" that can be used to make the elongated rectangular shaped container cover 190" of FIG. 9B shown covering a rectangular shaped container 400. In this example blank 170" has chamfered corners 170CC and a logo printed across the surface. Once formed chamfered corners 170CC form hemmed curved corners 170HC which provide a tight fit on container 400. Those experienced in the art can make the required size modifications to the apparatus parts to form cover 170" into cover 190".

FIG. 10 illustrates a modification which would eliminate unsealed pleat 173 (FIG. 7). In order to prevent a portion of the sheet from creasing or folding into the gap 136' between adjacent sealing bars, a compressed air nozzle 310 can be attached which in timed sequence with the sealing bar activation can shoot a blast of compressed air at the corner of the sheet. This will cause a pleat to fold inward between the closing sealing bar and the forming mandrel, thereby preventing a fold of material from getting caught between adjacent sealing bars. Instead of compressed air, a mechanical finger can also be used in timed sequence to tuck the corner inward and prevent a fold of material from getting caught in gap 136' between adjacent sealing bars. This modification would produce a container cover which has a hermetically sealed hem which some customers may want for sterile applications or to prevent water from migrating into the hem when the cover is washed.

Figure 11:
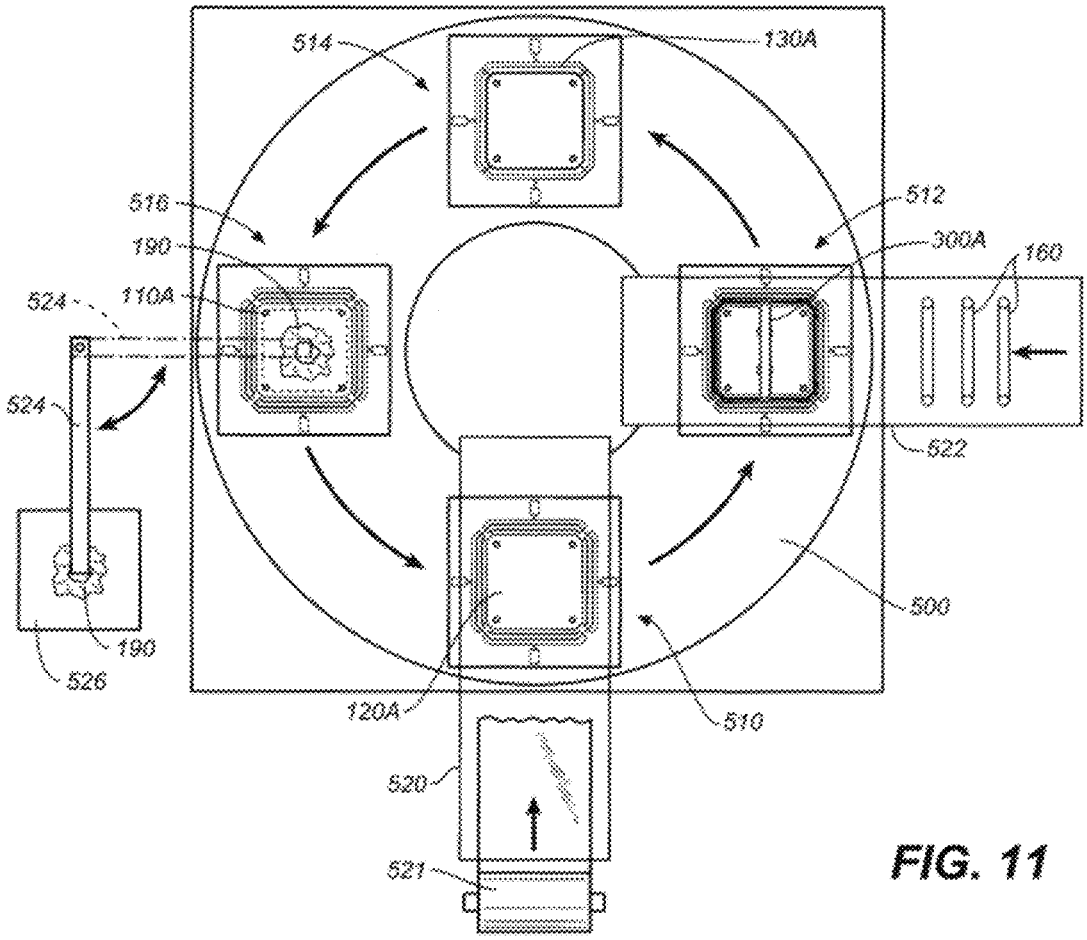
FIG. 11 is a plan view illustrating an automated process for manufacturing flexible container covers.

FIG. 11 shows an automated assembly line for manufacturing flexible containers covers. The automated assembly line integrates the apparatus parts and process functions disclosed in the first embodiment along with additional processing steps and apparatus well known in the art. The automated assembly line comprises a machine having a rotating circular turn table 500 with four forming mandrels 120A (similar to forming mandrel 120), secured to the turntable and positioned 90° apart. Each forming mandrel is surrounded by sealing bars 130A (similar to sealing bars 130). The mandrels and sealing bars move together on the rotating turntable. There are four fixed positions or stations that correspond to the positions of each of the four mandrels.

A first station 510 comprises a die-cutting apparatus 520. The die cutting apparatus comprises an unwind stand, web guides, and a punching unit all well known in the art.

A second station 512 comprises a forming head apparatus 300A and band feeding apparatus 522. Forming head 300A (similar to forming head 300) comprises a forming die and band ejector plate. Band feeding apparatus 522 comprises a conveyor of matching sets of hooks or pins which automatically stretch and release rubber bands around the forming die. The rubber bands can initially be put on the hooks manually, or by an automated descrambling apparatus that would descramble individual rubber bands from a jumbled mass and place them on the hooks. Alternatively elastic bands can be formed directly around the forming die from two separate ribbons of elastic as disclosed in U.S. Pat. No. 5,749,989 to Linmann et al., which is incorporated by reference. Alternatively the band feeding can be performed by a worker positioned at this station with a supply of rubber bands; the worker manually stretches and applies the rubber band around the forming die.

At a third station 514 no fabrication action is taken. This station therefore provides a dwell or pause to allow the seam to be sealed.

A fourth station 516 comprises an eject plate 110A, (similar to eject plate 110), and an accumulating apparatus 524 which is designed to pick up and stack the finished covers after they have been stripped from the forming mandrel. The accumulating apparatus can comprise a reciprocating overhead arm equipped with a vacuum cup for picking up an ejected cover and moving it to an accumulation bin 526.

Starting at first station 510 a roll of film material 521 is loaded on the unwind stand and fed through web guides (not shown) to die cutter 520. Next the die cutter punches a blank (similar to blank 170) and places the blank on top of forming mandrel 120A. The blank is placed with a mechanical positioner or, alternatively with a blast of compressed air. A series of vacuum holes in the top of the mandrel hold the blank in place when the turntable moves the mandrel to the next station.

Next the turntable rotates 90° counter-clockwise (CCW) as shown by the arrows to second station 512 and places the first mandrel with the blank on top under forming head 300A. Band feeding apparatus 522 (or a worker) next applies a rubber band to the forming die. The forming die is lowered to form the sheet and apply the rubber band as described earlier. The forming head moves up and sealing bars 130A are actuated along with a heating element (not shown) to form and seal a hem containing the elastic band.

Next the turntable indexes another 90° CCW to third station 514 station where sealing bars 130A continue to be pressed against the sides of the mandrel for a predetermined interval to seal the hem.

Finally the turntable moves to the fourth station 516 where sealing bars 130A are deactivated. Eject plate 110A is the activated to strip the cover from the mandrel as described for the first embodiment. Accumulator apparatus 524 next moves into position above the loose cover, and with the use of a vacuum picks up the cover and transfers it to accumulation bin 526. The process is repeated sequentially as each mandrel intermittently indexes to each respective station. If the dwell at each station is 0.75 second and it takes 0.25 second to move a mandrel between stations, the total time to complete one cover is 4 seconds, so the throughput would be one cover per second or 60 finished covers per minute.

CONCLUSIONS, RAMIFICATIONS, SCOPE

The reader will see that according to the disclosure, I have provided a flexible container cover and fabrication method that can fit containers, plates, and bowls in a variety of shapes and sizes, made from a sheet of film and having a continuous hem covering an elastic band about the periphery of the sheet. The hem can have an unsealed section or unsealed pleat which prevents air from being trapped within the hem so that it does not burst when used in a microwave oven. Alternatively the hem can be hermetically sealed. The process and apparatus can form the flexible container covers from round, elliptical, rectangular, or square blanks. It utilizes a forming head which simultaneously forms the sheet and applies the elastic band and automatically strips the formed cover from the sealing apparatus. The process and apparatus can be integrated into an automated assembly line for the high speed production of flexible container covers.

While certain representative embodiments and details have been shown for purposes of illustrating the disclosure, it will be apparent to those skilled in the art that various changes in the methods and apparatus disclosed may be made without departing from the scope of the disclosure. For example the starting sheet can have square corners, radius corners, or chamfered corners. Rectangular sheets similar to the sheets shown in my pending application Ser. No. 11/840,019, filed Aug. 16, 2007 and incorporated by reference can be used. These sheets have a section of material removed from each corner. Such sheets or blanks can be formed with the method and apparatus detailed in the current disclosure, producing a cover with an interrupted hem and exposed band at each corner.

In lieu of rubber bands, any other elastic band may be used, such as rubber covered by a sleeve, rubber covered by wound thread, elastic plastic, a coiled metal spring (in a sleeve or without a sleeve), etc.

The primary graphical alignment indicator means disclosed in my pending application Ser. No. 12/363,528, filed Jan. 30, 2009 and incorporated by reference can be incorporated into the present blanks to allow the user to quickly and easily identify which direction to pull, place, or orient the cover in order to keep the sides parallel with the sides of a rectangular container.

The size and shape of the apparatus tooling parts, such as the forming mandrel, forming die, band ejector mechanism, cover ejector mechanism, and sealing bars can all be modified. For example instead of using eight band-ejector pins, any other number of pins can be provided to push the band off of the forming die. In lieu of pins, other pushing or ejecting means can be used. Similarly, instead of using four cover ejector pins, any other number of pins can be provided to push the formed cover off of the forming mandrel. In lieu of pins, other pushing, pulling, or ejecting means can be used, such as compressed air or vacuum.

A separate strip of wire or heating element can be secured to each side of the forming mandrel instead of using one long continuous wire. The hem can be sealed by other means of melting and fusing the overlapping plastic. A different color elastic band 160 can be used for different size covers to help differentiate the sizes. For example, a cover sized to fit containers 10.2 cm (4 inches) to 22.9 cm (9 inches) can use a yellow rubber band, while a cover sized to fit containers 22.9 cm (9 inches) to 35.6 cm (14 inches) can use a green rubber band and so forth. Instead of four mandrel positions on the rotating turntable, there could be 8 mandrel positions (45 degrees apart) for the four stations which would reduce the travel time and increase the throughput of the machine.

The stations of the automated assembly line process can be configured in a linear layout instead of a circular layout. Instead of a reciprocating arm the accumulator apparatus can be a rotating station with plural picking heads for removing the finished covers from the forming mandrel in timed sequence.

In lieu of covering food containers, the cover can be used to cover any other type of container, such as laboratory specimens, mechanical or electronic parts, biological materials, office materials, etc.

Thus the scope should be determined by the appended claims and their legal equivalents, and not by the examples given.

The invention claimed is:

1. A method of making a flexible cover, comprising:

(a) providing a forming mandrel with a top surface and a sidewall depending therefrom;

(b) providing a sealing bar having a top and spaced apart from said sidewall;

(c) providing a forming die having a cavity defined by a sidewall, said cavity being sized so that it can telescope over said forming mandrel;

(d) stretching an elastic band around said forming die;

(e) placing a sheet of film across said top surface of said forming mandrel so that the sides of said sheet extend past the sides of said forming mandrel with the free edges of said sheet being positioned above a portion of said sealing bar;

(f) telescoping said die over said forming mandrel;

(g) moving said elastic band from said forming die and around said forming mandrel, thereby holding the sides of said sheet against said sidewall sides of said mandrel with the free edges of said sheet flaring outward past said elastic band and resting along said top of said sealing bar;

(h) closing the space between said sealing bar and said mandrel so that the free edges of said sheet are bent upward and against said sidewall of said mandrel to form a hem around said elastic band; and (i) sealing said hem through the application of heat and pressure to enclose said elastic band around the perimeter of said sheet to form a flexible cover.

2. The method of claim 1, further including opening the space between said sealing bar and said mandrel and mechanically stripping said cover from said mandrel.

3. The method of claim 1 wherein said mandrel sidewall is tapered.

4. The method of claim 1 wherein the step of moving said elastic band from said forming die around said forming mandrel comprises mechanically pushing said elastic band off of said die when said die is telescoped over said forming mandrel.

5. The method of claim 1 wherein said sheet is biodegradable.

6. The method of claim 1 wherein said sheet is rectangular.

7. A method of making a flexible cover, comprising:

(a) providing a forming mandrel having a perimeter, a top surface and sidewall depending therefrom;

(b) providing a plurality of sealing bars, each having a top surface and a front side, said sealing bars being positioned around said perimeter of said forming mandrel and spaced from said mandrel by a predetermined distance to create a moat between said sidewall of said mandrel and said front sides of said sealing bars;

(c) positioning a film sheet across said top surface of said forming mandrel with the edges of said sheet extending past said moat and resting on said top surfaces of said sealing bars such that a marginal portion of said sheet adjacent said edges is suspended above said moat;

(d) providing a forming die having a cavity defined by a sidewall, said cavity having a predetermined size so that said die can telescope over said forming mandrel;

(e) stretching an elastic band around said sidewall of said forming die;

(f) telescoping said die over said forming mandrel, thereby forming said marginal portion of said sheet around said mandrel and into said moat in a generally V-shaped configuration;

(g) moving said elastic band from said sidewall of said die and onto said mandrel, thereby holding said sheet against said sidewall of said mandrel;

(h) removing said die from said telescoped configuration;

(i) pushing said sealing bars against said sidewall of said mandrel to close the top portion of said V-shaped configuration to form a hem which encloses said elastic band along the perimeter of said sheet; and (j) sealing said hem by the application of heat and pressure to form a flexible cover.

8. The method of claim 7, further including pushing said flexible cover off said forming mandrel from the underside of said cover.

9. The method of claim 8 wherein said pushing said flexible cover off said forming mandrel comprises using a set of pins to mechanically push said cover off.

10. The method of claim 7 wherein said moving said elastic band from said forming die to said forming mandrel comprise using a set of pins to mechanically push said elastic band off of said die when said die is telescoped over said forming mandrel.

11. The method of claim 7 wherein said hem is continuous.

12. The method of claim 7 wherein said sealing of said hem is effected hermetically.

13. The method of claim 7 wherein said sheet is substantially rectangular in shape.

14. The method of claim 13 wherein said hem is continuous.

15. A method of making a flexible cover, comprising:

(a) providing a forming mandrel having a top surface and sidewall depending therefrom;

(b) providing a sealing bar having a top surface, said sealing bar positioned around the sides of said forming mandrel and spaced from said mandrel to create a gap between said mandrel and said sealing bar;

(c) draping a sheet of film across said top surface of said forming mandrel with the sides of said sheet extending past said top surface of said mandrel;

(d) providing a forming die having a cavity defined by a sidewall, said cavity having a predetermined size so that said die can telescope over said forming mandrel;

(e) stretching an elastic band around said sidewall of said forming die;

(f) telescoping said die over said forming mandrel such that the sides of said sheet are formed around the sides of said forming mandrel;

(g) moving said elastic band from said sidewall of said die and onto said mandrel, thereby holding the sides of said sheet against said sidewall of said mandrel with the free edges of said sheet extending past said elastic band and resting on said sealing bar;

(h) removing said die from said telescoped configuration;

(i) closing said gap between said mandrel and said sealing bar so that the free edges of said sheet are folded upward around said elastic band;

(j) pressing said sidewall of said mandrel and said sealing bar against each other, thereby forming said free edges of said sheet into a hem which encloses said elastic band along the perimeter of said sheet;

(k) sealing said hem by the application of heat and pressure to form a flexible cover; and (l) opening said gap between said mandrel and said sealing bar and mechanically pushing said flexible cover off said forming mandrel from the underside of said cover.

16. The method of claim 15 wherein said sidewall of said mandrel is tapered.

17. The method of claim 15 wherein said moving said elastic band from said wall of said die and onto said mandrel comprises mechanically pushing said elastic band off of said die when said die is telescoped over said forming mandrel.

18. The method of claim 15 wherein said sheet is rectangular.

19. The method of claim 18 wherein said hem is continuous.

20. The method of claim 15 wherein said steps (a) to (l) are performed by automated machinery without manual processing.

* * * * *